United States Patent [19]

Danguillier et al.

[11] 4,066,420

[45] Jan. 3, 1978

[54] PROCESS FOR THE GASIFICATION OF SOLID FUELS

[75] Inventors: Wilhelm Danguillier, Bochum; Wolfgang Grams, Wanne-Eickel, both of Germany

[73] Assignee: Dr. C. Otto & Comp. G.m.b.H., Bochum, Germany

[21] Appl. No.: 774,466

[22] Filed: Mar. 4, 1977

Related U.S. Application Data

[63] Continuation-in-part of Ser. No. 684,112, May 7, 1976, abandoned.

[51] Int. Cl.[2] ..... C10J 1/00

[52] U.S. Cl. ..... 48/197 R; 48/202; 48/210; 48/DIG. 2; 201/28; 252/373

[58] Field of Search ..... 48/210, 197 R, 202, 48/203, 206, DIG. 4, 76, 77, 92, DIG. 1, DIG. 2; 201/28; 252/373

[56] References Cited

U.S. PATENT DOCUMENTS

| | | | |
|---|---|---|---|
| 1,225,396 | 5/1917 | Benjamin | 48/210 |
| 2,113,774 | 4/1938 | Schmalfeldt | 48/206 |
| 2,614,915 | 10/1952 | Hirsch | 48/203 |
| 2,687,950 | 8/1954 | Kalbach | 48/197 R |
| 2,801,158 | 7/1957 | Grossman et al. | 48/DIG. 4 |
| 2,898,272 | 8/1959 | Odell | 48/203 |
| 3,437,561 | 4/1969 | Squires | 48/77 |
| 3,854,896 | 12/1974 | Switzer et al. | 48/210 |
| 3,957,458 | 5/1976 | Squires | 48/210 |

FOREIGN PATENT DOCUMENTS

| | | |
|---|---|---|
| 1,245,875 | 1/1960 | France. |
| A70,981 | 1/1957 | France. |
| 1,056,635 | 5/1959 | Germany. |
| 893,057 | 4/1962 | United Kingdom. |

*Primary Examiner*—S. Leon Bashore
*Assistant Examiner*—George C. Yeung
*Attorney, Agent, or Firm*—Thomas H. Murray

[57] ABSTRACT

A process for gasification of pulverized or fine-grain coal is characterized by using a portion of the combustible gas generated at a temperature between 1500° and 2200° C in a slag bath generator as a gaseous agent that is mixed with the coal and then introduced under pressure into the slag bath generator. The portion of the combustible gas to be used for this purpose undergoes processing which includes extracting dust, cooling and drying before the gas is combined with the fuel. According to a different embodiment, the combustible gas produced in the generator is used in the reduction process by feeding the gas into a reduction shaft furnace. The top gas from the shaft furnace is processed by extracting dust, cooling, drying and normalizing the acidity of the top gas before the top gas is combined with fuel for introduction as a mixture into the slag bath generator.

11 Claims, 3 Drawing Figures

PROCESS FOR THE GASIFICATION OF SOLID FUELS

CROSS-REFERENCE TO RELATED APPLICATION

This application is a continuation-in-part of application Ser. No. 684,112, filed May 7, 1976 now abandoned.

BACKGROUND OF THE INVENTION

This invention relates to a process for the gasification of pulverized or fine-grain solid fuels which are introduced under pressure into a gasification reactor by means of a gaseous agent. More particularly, the present invention relates to such a process wherein the gaseous agent is supplied by using a portion of the gas produced by the gasification reactor.

It is not preferred or economically feasible to process coal in a solid form to reduce the sulfur content before a gasification process. At the present time, effort is being directed to gasifying the coal in a finely-divided form and then reducing the sulfur component of the gas because it is easier to liberate the sulfur content from a gas than from a solid coal. Environmental protection is a continuously important consideration in a coal gasification process.

It is known in the art to convey solid fuel by mixing the fuel with a noncombustible gas, for example, carbon dioxide, water vapor, or some other gas usable as a gasification agent, e.g., air, oxygen or oxygen-enriched air. In many cases, the use of such gaseous substances to convey solid fuel causes difficulties in the required gasification process. For example, noncombustible gases may be totally unusable or usable in limited quantities because their introduction with the fuel inhibits the required quality of gas produced in the gasification reactor. Depending upon the type of gasification operation, there is also a fixed limit to the volume of gas per unit of weight of solid fuel that can be used as the gasification agent. In many cases, the quantity of the gasification agent usable for pneumatic conveying is insufficient for the purpose of introducing solid fuel into a gasification reactor. If oxygen-containing gases are used as the vehicle for introducing solid fuel into a gasification reactor, there is a danger of explosion before the mixture is introduced, particularly if such gases are raised to an elevated pressure. On the other hand, the reliability of ignition of the fine-grain fuel in the gasification reactor is especially important because the gasification of coal is done at high temperatures, e.g., between 1500° and 2200° C.

SUMMARY OF THE INVENTION

It is an object of the present invention to introduce solid fuel into a gasification reactor through the use of a gaseous vehicle which is selected to avoid the risk of explosion outside the reactor and which will accelerate the start of the required gasification reaction with only little interference or hindrance to the gasification process.

According to the present invention there is provided a gasification process for pulverized or fine-grain ash-containing coal used as a fuel, the process includes combining such coal with a gaseous agent to form a mixture for introduction under pressure into a slag bath generator, gasifying such coal in the presence of introduced gasifying media such as oxygen and steam and of included ash in the coal at a temperature between 1500° and 2200° C, and using a portion of the combustible gas generated by the slag bath generator as the gaseous agent for combination with the coal to form the mixture to reliably support combustion within the slag bath generator.

Thus, according to the present invention, a portion of the combustible gas produced within a gasification reactor is used to convey the ash-bearing, pulverized or fine-particle coal used as a fuel in the process. In this way, the gaseous conveying agent has only little adverse influence on the gasification process and to the contrary the gas from the gasifier contains combustible constituents that initiate the combustion processes, which are the primary gasification reactions, more rapidly and without incurring ignition difficulties. Oxygen and/or steam is fed separately into the gasifier to enable gasifying the fuel. There are no appreciable gas losses in this process since the combustible gas used as the vehicle is recovered practically in its entirety at the output of the gasification reactor.

Advantageously, a portion of the gas withdrawn from the output of the gasification reactor undergoes processing including a dust extraction process and cooling to at least partially cool the gas. The gas, before use as a vehicle to carry the solid fuel into the gasification reactor, undergoes further processing that includes drying by, for example, compressing the gas. In the event that the output of the gasification reactor is used for reduction processes, e.g., in a shaft furnace, then the vehicle for conveying the solid fuel is obtained from the top gas of the reduction process. The top gas is processed before use as the conveying vehicle by a dust extraction process, a cooling process, normalizing the gas to eliminate its acidity and drying the gas.

These features and advantages of the present invention as well as others will be more readily understood when the following description is read in light of the accompanying drawings, in which.

Figure 1:
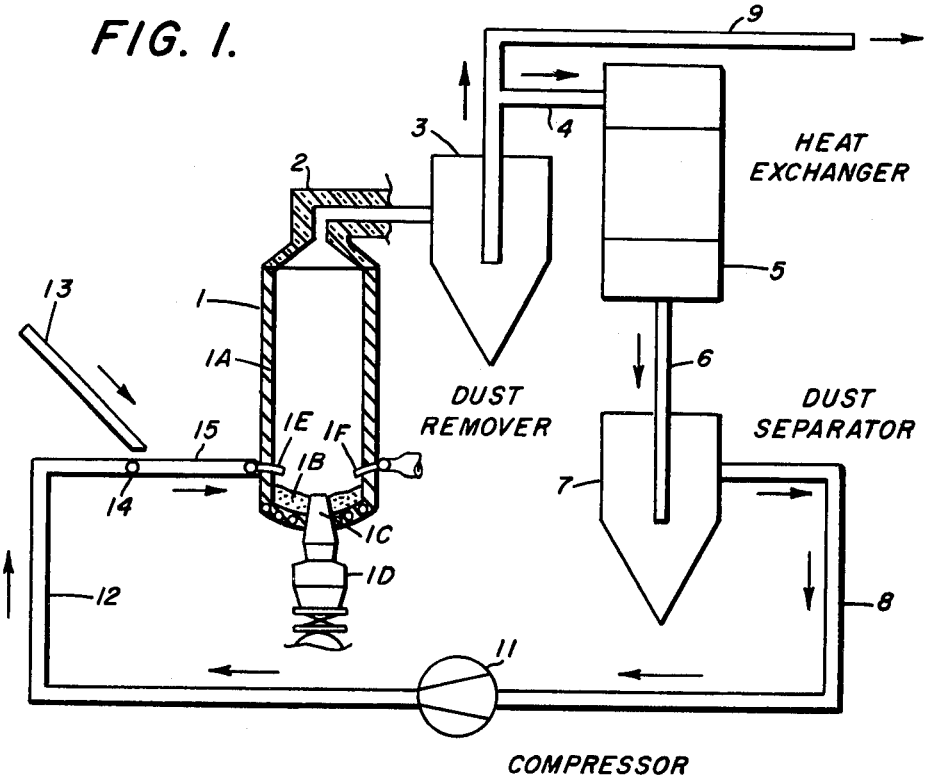
FIG. 1 is a schematic diagram of a gasification process including the features of the present invention.

In the process of FIG. 1, pretreated and heated fuel is gasified to produce a reduction gas. It is not possible to employ carbon dioxide or water vapor as the vehicle for conducting the fuel into the reaction vessel for the gasification process because the fuel does not have a sufficiently high calorific value to reduce the additional flow of carbon dioxide or water vapor while producing a gasified product of the required degree of reduction. The use of oxygen is impossible in this environment since the fuel is delivered at a temperature above the ignition temperature whereby combustion will take place and be initiated in the conveyor system. In the embodiment of the present invention according to FIG. 1, the combustible gas produced in a gasification reactor 1 is fed by pipe 2 into a high temperature dust remover 3. The gasification reactor 1 takes the form of a pressurized slag bath generator which includes a cylindrical pressure vessel 1A wherein a slag bath 1B is formed in the bottom of the vessel. Slag is continuously generated from noncombustible constituents of the coal at an operating temperature of between 1500° to 2200° C. The slag bath is maintained at a predetermined desired height by an overflow 1C which discharges the overflowing slag into a collecting tank 1D. This tank is filled with coolant water and includes a valve in the bottom thereof to form part of a pressure lock system for discharging the slag into an underlying discharge vessel, not shown, are used to protect the bottom and side walls of the vessel. The gases entering pipe 2 from the vessel have a temperature of between 800° and 900° C because of the mixing of cool recycle-gas to it in the upper part of the gasifier. The pipe 2 may take the form of a cupola. The entry temperature of the gases into the dust remover 3 is about 900° C. The majority of the combustible gas produced in the gasification reactor 1 is delivered for further other uses by a supply pipe 9 from the dust remover 3. The portion of the combustible gas for use as a medium to convey fuel into the gasification reactor is delivered by pipe 4 from the dust remover to a heat exchanger 5 where the gas is cooled to a required temperature. Pipe 6 delivers the gas from the heat exchanger 5 to another dust separator 7 to remove fine dust particles from the gas and thereby to protect a compressor 11 from excessive wear and damage as the gas is delivered thereto by pipe 8. The gas used for conveying pulverized or fine-grain coal used as fuel according to the present invention is elevated to a temperature of between 20°–450° C, preferably at a temperature of 250° C. The gas is delivered by a pipe 12 to a conveyor 14 where it is charged with hot fuel from pipe 13 for delivering the gas and fuel mixture under pressure to the gasification reactor 1 by way of pipe 15. Pipe 15 is connected to a set of nozzles 1E used to introduce the hot fuel-gas mixture into the slag bath generator wherein the gasification process takes place in a well known manner. The gases combined with the fine-grain coal include $CO_2$, CO and $H_2$. Other nozzles 1F feed oxygen and/or steam directly into the gasification reactor for the gasification process.

In the gasification reactor, the oxygen and/or steam supply $O_2$ for a reactor with the carbon of the fuel to thereby gasify to carbon of the coal. The oxygen and/or steam form a gasification medium which is introduced into the reactor at a temperature of about 300° C. Oxygen is introduced at a rate of 1 Kg per Kg of fuel. Steam is introduced into the reactor at a rate of 0.33 Kg per Kg of fuel.

Figure 2:
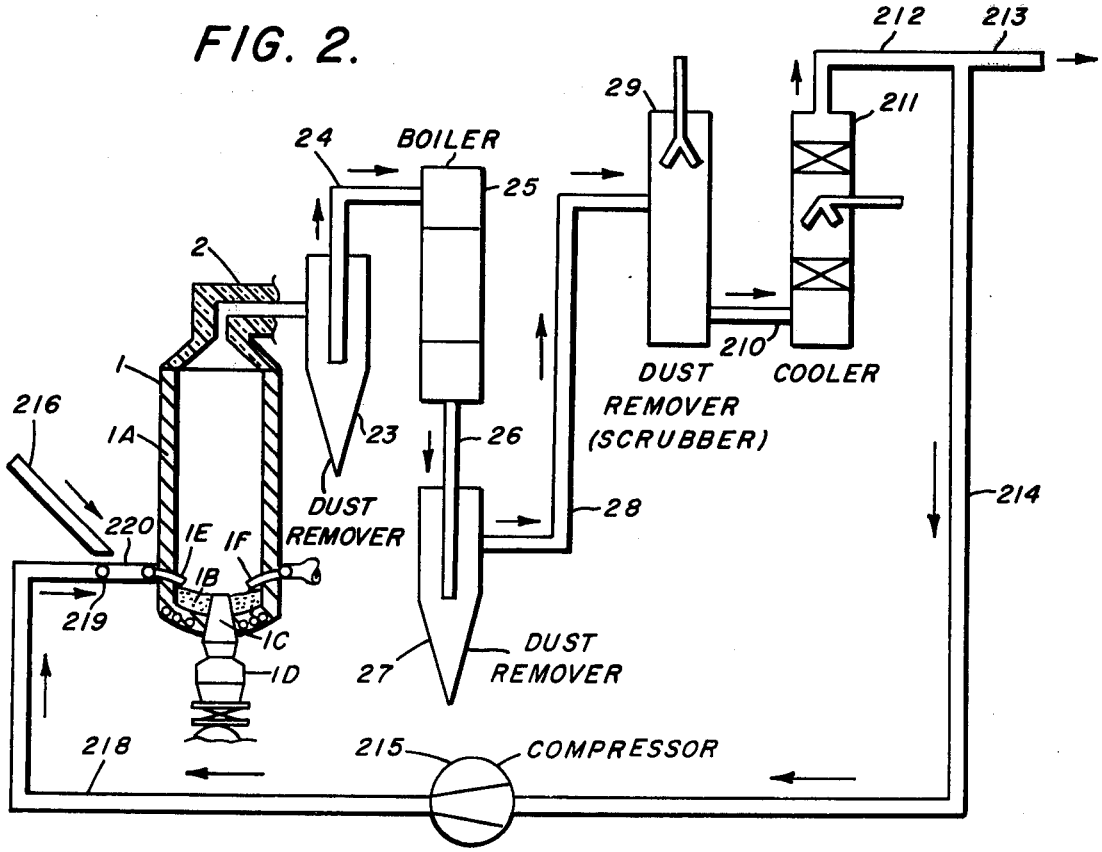
FIG. 2 is a schematic diagram illustrating a modification to the process shown in FIG. 1.

In the embodiment according to FIG. 2, there is illustrated a gasification process which according to the present invention relates to a pressure gasification process wherein it is impossible to use oxygen as a medium for conveying fuel. It is also pointed out that the use of carbon dioxide as a conveying medium will render the gasification process unnecessarily expensive since carbon dioxide must be compressed to a high pressure level. Moreover, it is impossible to use steam as a conveying medium because the fuel is at room temperature and there is a risk of condensation on the fuel. As shown diagrammatically in FIG. 2, the combustible gas passed from the gasification reactor 1 is passed into dust removal devices 23, 27 and 29. The temperature of the gas is reduced in the waste heat boiler 25, scrubber 29 and cooler 211. More specifically, the gas generated in reactor 1 is delivered by pipe 2 into a dust removal device 23, from where the gas is discharged by pipe 24 to the waste heat boiler 25. A dust removing device 27 receives the gas delivered by pipe 26 from the boiler 25. Pipeline 28 delivers the gas from the dust removing device 27 into a dust removing device 29 in the form of a scrubber from where pipeline 210 discharges the gas into the cooler 211. Pipeline 212 conducts the gas which is now cooled and the dust removed therefrom. Pipeline 212 is branched to provide an output of gas in pipe 213 and a subflow or return portion of the gas in pipeline 214. The gas conducted by pipeline 214 is used for conveying solid fuel into the reactor. This is carried out according to the present invention by employing a compressor 215 to slightly increase the pressure of the gas. The pressurized gas is conducted by pipeline 218 at temperatures between 20° C and 220° C, preferably at 70° C to a conveyor device 219 where the gas is charged with cold fuel from pipeline 216. The fuel and gas mixture is conveyed under pressure into the gasification reactor 1 by pipeline 220.

Figure 3:
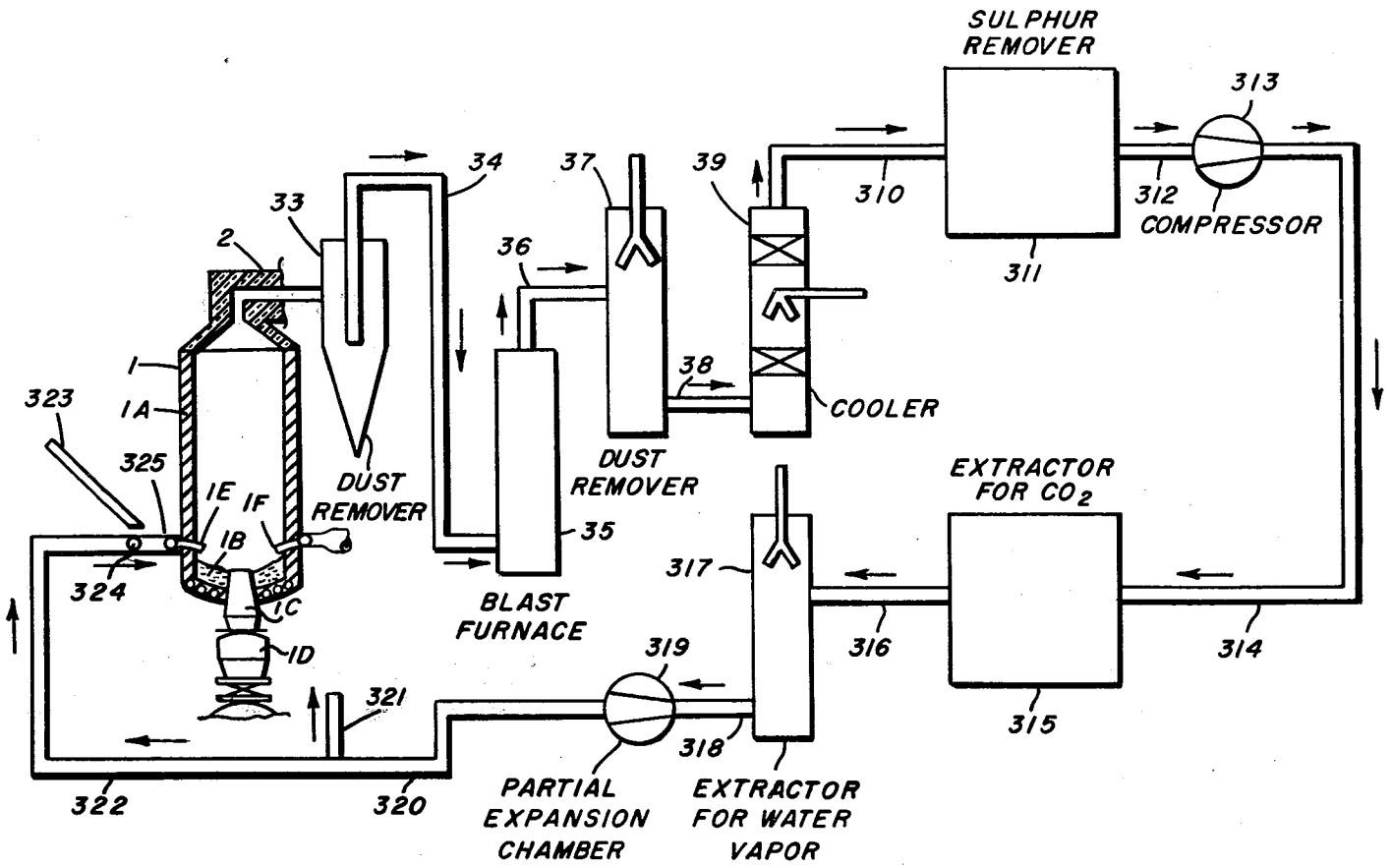
FIG. 3 is a schematic illustration illustrating a further modification to the process shown in FIG. 1.

FIG. 3 illustrates a further embodiment of the gasification process according to the present invention. In this embodiment, the gas discharged from the gasification reactor 1 is conducted by pipe 2 into dust remover 33 and then by pipe 34 to an ore reduction shaft furnace 35. The furnace 35 is used to produce iron by direct reduction without melting. The partially spent top gas, which escapes from the shaft furnace is delivered by pipeline 36 to a dust extractor 37 from where the gas is delivered by pipeline 38 to a cooler 39. The gas, after cooling and dust removal, is passed by line 310 to a sulfur remover 311 where sulfur in the gas is removed. Typically, the sulfur remover 311 is a chamber wherein a water or aqueous alkaline ammonia solution is used to scrub the sulfur content, e.g., $H_2S$, from the gas. The top gas can be normalized by other well known devices. The gas is then compressed by compressor 313 and fed by line 314 to processors 315 where the carbon dioxide and water vapor content of the gas are eliminated as far as possible. Pipe 316 delivers the gas to an extractor 317 for water vapor from where the gas is conducted by pipe 318 for partial expansion by gas turbine 319. The pipeline 320 conducts the gas which after processing as just described is available for further use. Part of this gas is conducted by pipe 321 for use at a remote destination, for example, by returning the gas back to the blast furnace 35. A subflow or partial flow of the gas is withdrawn by pipe 322 at a temperature of between 20° and 310° C preferably at 35° C for delivery to a conveyor device 324. The conveyor device 324 receives pulverized or fine-grain coal which has been heated as used as a hot fuel and delivered by pipe 323. The mixture of hot fuel and gas is delivered under pressure by pipeline 325 into the gasification reactor 1 through the set of nozzles 1E.

The sulfur remover 311 is constructed and operates in accordance with the state of the art in regard to the removal of sulfur from a stack or top gas passed from an ore reduction shaft furnace. According to the process of the present invention, inorganic sulfur is removed from the gas in two stages and by using a wet process to reduce the residual sulfur content in the gas to 0.0008% by volume. However, such an extreme reduction to the inorganic sulfur content of the gas is not essential. In the process the main objective is to remove, as far as possible, carbon dioxide where there is a secondary condition that the carbon dioxide obtained is practically free of $H_2S$.

The amount of gas conducted by lines 12, 218 and 322 in embodiments shown in FIGS. 1, 2 and 3, respectively, is dependent on the amount of coal which is gasified and the pressure within the gasification reactor 1. A desired amount of return gas per metric ton of coal lies between 15 and 93 $Nm^3$, preferably at 75 $Nm^3$ per metric ton of coal. The gas serves as a conveying medium for the coal. However, under specific conditions, the amount of gas used for this purpose can be significantly higher. It will be understood that the number of conveyor systems used to conduct the mixture of fuel and gas into the reaction chamber is actually between four to six conveyor systems. The gasification agent, i.e., steam and/or oxygen, at a temperature of about 300° C is fed into the gasification chamber by nozzles 1D to react with the carbon of the fuel supplied by nozzles 1E. As previously described, 1 Kg of oxygen per Kg of fuel is fed separately into the gasification reactor. Steam is supplied at a rate of 0.33 Kg per Kg of fuel. An example of a specific condition where the gasification process is carried out under a partial load occurs when repairwork is carried out on one of the conveyor systems. In the partial load condition, the corresponding jets are fed with recycled gas and oxygen-containing gases to maintain these jets free. Under normal operating conditions with usual long-flame gas-coal and a pressure of 25 atmospheres, the amount of gas fed back for mixture with the coal and introduced into the gasification reactor is normally 5% of the amount of gas produced by the reactor.

A typical particle size distribution of the finely-powdered coal introduced into the gasification reactor is as follows:

Condition A where operation is carried out under a partial load at 25 atmospheres with long-flame gas-coal:

| | |
|---|---|
| 30% | 40– 90 (mesh size) |
| 40% | 170– 300 (mesh size) |
| 1% | 1300–2200 (mesh size) |

Condition B is a normal operation at 25 atmospheres with long-flame gas-coal:

| | |
|---|---|
| 80% | 40– 170 (mesh size) |
| 40% | 210– 700 (mesh size) |
| 1% | 1500–1700 (mesh size) |

Although the invention has been shown in connection with a certain specific embodiment, it will be readily apparent to those skilled in the art that various changes in form and arrangement of parts may be made without departing from the spirit and scope of the invention.

We claim as our invention:

1. A process for the gasification of pulverized or fine-grain coal which is introduced as a mixture with a gaseous agent consisting essentially of CO, $H_2$ and $CO_2$ in a slag bath generator, said process including the steps of combining said gaseous agent with said coal to form a mixture, introducing said mixture into a slag bath generator, gasifying the coal in the presence of introduced gasifying medium and of included ash in the coal in said generator at a temperature of between 1500° C and 2200° C, withdrawing liquid slag from said slag bath generator, and using a portion of the combustible gas generated by said slag bath generator as said gaseous agent.

2. The process according to claim 1 including the further steps of extracting dust from a divided portion of combustible gas withdrawn from said slag bath generator for said step of using a portion of the combustible gas, and cooling the divided portion of combustible gas withdrawn from said slag bath generator for said step of using a portion of the combustible gas.

3. The process according to claim 2 including the further step of drying the divided portion of combustible gas for said step of using a portion of the combustible gas.

4. The process according to claim 3 wherein said step of drying the divided portion of combustible gas is carried out by compressing the divided portion of combustible gas.

5. The process according to claim 1 including the further step of maintaining an elevated pressure in said slag bath generator during the step of gasifying.

6. The process according to claim 1 including the further step of maintaining a pressure of 25 atmospheres in said slag bath generator during said step of gasifying.

7. The process according to claim 1 wherein said gasifying medium includes steam.

8. The process according to claim 1 wherein said gasifying medium includes oxygen.

9. The process according to claim 1 wherein said gasifying medium has a temperature of about 300° C when fed into said slag bath generator.

10. The process according to claim 1 wherein said gasifying medium includes steam at 300° C and fed into said slag bath generator at a rate of 0.33 Kg per Kg of coal.

11. The process according to claim 1 wherein said gasifying medium includes oxygen at 300° C and fed into said slag bath generator at a rate of 1 Kg per Kg of coal.

* * * * *